United States Patent [19]

Bridger et al.

[11] 3,997,597

[45] Dec. 14, 1976

[54] ALKALI METAL OR TETRAALKYLAMMONIUM ARYLCARBAMATES

[75] Inventors: Robert F. Bridger, Hopewell; El-Ahmadi I. Heiba; Stamoulis Stournas, both of Princeton, all of N.J.

[73] Assignee: Mobil Oil Corporation, New York, N.Y.

[22] Filed: June 17, 1974

[21] Appl. No.: 479,739

Related U.S. Application Data

[62] Division of Ser. No. 310,752, Nov. 30, 1972, Pat. No. 3,849,320.

[52] U.S. Cl. ..... 260/518 R; 260/287 T; 260/501.11

[51] Int. Cl.[2] ..... C07C 125/02

[58] Field of Search ..... 260/518 R, 501.11, 534 B, 260/28 TT

[56] References Cited

UNITED STATES PATENTS

| | | | |
|---|---|---|---|
| 2,463,963 | 3/1949 | Gorcica et al. | 260/534 B |
| 2,957,826 | 10/1960 | Martinek | 260/534 B X |
| 3,061,637 | 10/1962 | Martinek | 260/534 B X |
| 3,455,929 | 7/1969 | Belleau et al. | 260/287 T |
| 3,773,936 | 11/1973 | Shen et al. | 260/518 R |

*Primary Examiner*—Richard L. Raymond
*Attorney, Agent, or Firm*—C. A. Huggett; R. W. Barclay; T. S. Szatkowski

[57] ABSTRACT

Organic compositions, particularly lubricating compositions in the form of lubricating oils and greases, are provided, containing, as antioxidants, alkali metal arylcarbamates.

6 Claims, No Drawings

ALKALI METAL OR TETRAALKYLAMMONIUM ARYLCARBAMATES

This is a division of application Ser. No. 310,752, filed Nov. 30, 1972, now U.S. Pat. No. 3,849,320.

BACKGROUND OF THE INVENTION

1. Field of the Invention

This invention relates to organic compositions having improved antioxidant properties. In one of its aspects, the invention relates, more particularly, to lubricant compositions in the form of lubricating oils and greases containing novel and improved antioxidant additives.

2. Description of the Prior Art

Various antioxidant agents for use in organic compositions, particularly lubricants in the form of lubricating oils and greases have heretofore been suggested. In many instances, it has been found, however, that such antioxidants, e.g., amines or phenolic compounds, do not impart desirable alkaline properties to the lubricants. In other instances, such antioxidants do not exhibit a sufficiently effective degree of inhibiting oxidation. In general, therefore, these antioxidant additives have not proved to be sufficiently attractive to warrant any extensive industrial application.

SUMMARY OF THE INVENTION

In accordance with the present invention, new and improved lubricant compositions in the form of lubricating oils and greases are provided, containing, as antioxidant agents, certain alkali metal arylcarbamates. More specifically, these carbamates comprise alkali metal arylcarbamates, diarylcarbamates and alkarylcarbamates having the structure:

$$R^1R^2NCO_2M$$

in which $R^1$ and $R^2$ are phenyl, naphthyl, alkyl, aryl or hydrogen; at least one of $R^1$ and $R^2$ is aryl; and M is selected from the group consisting of Li, Na, K, Rb, Cs or tetraalkyl ammonium.

When the above-described carbamates are incorporated in organic media such as lubricant compositions, in the form of lubricating oils and greases, it is found that they impart a relatively high degree of improvement in alkalinity and are highly effective in inhibiting oxidation of the media into which they are incorporated. In general, the carbamates are employed in minor amounts. In most instances, the carbamates are effectively employed in amounts from about 0.001 to about 5%, and, preferably, from about 0.1 to about 2%, by weight, of the total weight of the lubricant composition.

The carbamate antioxidant may be effectively incorporated in any oil of lubricating viscosity or in a grease composition in which the oil of lubricating viscosity is the vehicle in combination with a suitable thickening agent.

The lubricating oils which are improved with the antioxidants of the present invention may include mineral oils and synthetic oils of lubricating viscosities. Of particular significance is the improvement of petroleum distillate lubricating oils having boiling points as high as 650° F. or above and also mixtures of such oils. It should be noted, in this respect, that the term "distillate oils" is not intended to be restricted to straight-run distillate fractions. These distillate oils can be straight-run distillate oils, catalytically or thermally crack (including hydrocracked) distillate oils, or mixtures straight-run distillate oils, naphthas and the like, wi cracked distillate stocks and may be of varying visco ties and pour points. Moreover, such oils can be treat in accordance with well-known commercial metho such as acid or caustic treatment, hydrogenation, s vent-refining, clay treatment and the like.

As previously indicated, the aforementioned antio dants may also be incorporated in grease compositio Such greases, may comprise a combination of a wi variety of lubricating vehicles and thickening or gelli agents. Thus, greases in which the aforemention carbamates are particularly effective may comprise a of the conventional hydrocarbon oils of lubricati viscosity, as the oil vehicle, and may include mine oils or mineral oils in combination with synthetic lub cating oils, aliphatic phosphates, esters and di-este silicates, siloxanes and oxalkyl ethers and esters. Mi eral lubricating oils, preferably employed as the lub cating vehicle, may be of any suitable lubricating v cosity range from about 45 S.U.S. at 100° F. to abo 6,000 S.U.S. at 100° F., and, preferably, from about to about 250 S.U.S. at 210° F. These oils may ha viscosity indexes varying from below 0 to about 100 higher. Viscosity indexes from 70 to about 95 are pr ferred. The average molecular weights of these oils m range from about 250 to about 800. The lubricating is employed in the grease composition in an amou sufficient to constitute the balance of the total grea composition, after accounting for the desired quanti of the thickening agent, and other additive componen to be included in the grease formulation.

As hereinbefore indicated, the oil vehicles employ in the novel grease formulations, in which the afor mentioned antioxidant carbamates are incorporate may also comprise mineral oils or combinations mineral oils with synthetic oils of lubricating viscosi When high temperature stability is not a requireme of the finished grease, mineral oils having a viscosity at least 40 S.U.S. at 100° F., and particularly tho falling within the range from about 60 S.U.S. to abo 6,000 S.U.S. at 100° F. may be employed. In instanc where synthetic vehicles are employed in addition mineral oils, as the lubricating vehicle, various co pounds of this type may be successfully utilized. Ty cal synthetic vehicles include: polypropylene, polyp pylene glycol, trimethylol propane esters, neopen and pentaerythritol esters, di-(2-ethyl hexyl) sebaca di-(2-ethyl hexyl) adipate, di-butyl phthalate, fluo carbons, silicate esters, silanes, esters of phosphor containing acids, liquid ureas, ferrocene derivativ hydrogenated mineral oils, chain-type polypheny siloxanes and silicones (polysiloxanes), alkyl-su stituted diphenyl ethers typified by a butyl-substitut bis (p-phenoxy phenyl) ether, phenoxy phenyl ethe etc.

The lubricating vehicles of the aforementioned i proved greases containing the above-described antio dant carbamates, are combined with a grease-formi quantity of a thickening agent. These thickening gelling agents may include any of the conventio metal salts or soaps; which are dispersed in the lubric ing vehicle in grease-forming quantities, in such deg as to impart to the resulting grease composition, desired consistency. Other thickening agents that m be employed in the grease formation may comprise non-soap thickeners, such as surface-modified cl and silicas, aryl ureas, calcium complexes and similar materials. In general, grease thickeners may be employed which do not melt and dissolve when used at the required temperature within a particular environment; however, in all other respects, any materials which are normally employed for thickening or gelling hydrocarbon fluids for forming greases, can be used in preparing the aforementioned improved greases in accordance with the present invention.

The alkali metal arylcarbamates of the present invention, as more fully hereinafter described, may be prepared, in general, by reacting an arylamine, diarylamine or alkarylamine having the structure $R^1R^2NH$ with a derivative of an alkali metal having the structure MX at a temperature from about 0° C. to about 150° C., and preferably from about 25° C. to about 60° C., to produce a product having the structure $R^1R^2NM$; and reacting the product thus produced with carbon dioxide at a temperature from about 0° C. to about 60° C., and preferably from about 20° C. to about 30° C., to produce a product having the structure $R^1R^2NCO_2M$ in which $R^1$ and $R^2$ are phenyl, naphthyl, alkyl, aryl or hydrogen; at least one of $R^1$ and $R^2$ is aryl; M is selected from the group consisting of Li, Na, K, Rb, Cs or tetraalkyl ammonium; and X is selected from the group consisting of —H, $—NH_2$, $—N(CH_3)_2$, $—C_4H_9$, phenyl, —OH, $—OCH_3$, $OC(CH_3)_3$ and $—OC(CH_3)_2\ CH_2CH_3$.

DESCRIPTION OF SPECIFIC EMBODIMENTS

The following examples will serve to illustrate the novel alkali metal arylcarbamates of the present invention, the method for their preparation and their utility in organic lubricating media.

EXAMPLE 1

N-Phenyl-1-naphthylamine (29.2 grams, 0.133 mole) was added to an ice-cooled solution of butyl lithium (12 grams, 0.187 mole) in 100 ml of tetrahydrofuran over a period of 30 minutes while the solution was stirred under an argon atmosphere. The rate of addition was determined chiefly by the heat evolved during the reaction. Stirring was continued for 30 minutes and the solution was allowed to warm to room temperature. Dry carbon dioxide was pressed through the solution for 1 hour, and solvent was removed by evaporation in a vacuum. The product so obtained (39.6 grams), melting point 290°–292° C., was shown not to contain N-phenyl-1-naphthylamine by thin layer chromatography, and had minor impurities of lithium pentanoate and solvent. The N-H absorption was absent from the infrared spectrum which exhibited a carbonyl absorption at 6.2 microns. The compound, thus produced, had the following structure:

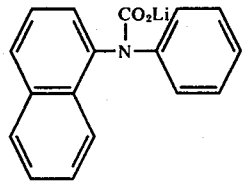

EXAMPLE 2

The procedure described in Example 1 was repeated, except that 34.1 grams of N-[p-(2,4,4-trimethyl-2-pentyl)phenyl]-1-naphthylamine and 7.5 grams of butyl lithium was employed. The resulting compound had the following structure:

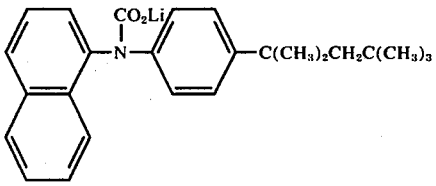

EXAMPLE 3

The procedure described in Example 1 was repeated, except that 29.2 grams of N-phenyl-2-naphthylamine and 12 grams of butyl lithium was employed. The resulting compound had the following structure:

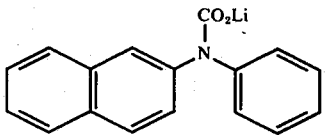

EXAMPLE 4

The procedure described in Example 1 was repeated, except that 7.5 grams of butyl lithium and 16.9 grams of diphenylamine was employed. The resulting compound had the structure:

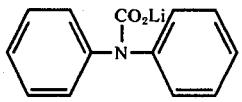

EXAMPLE 5

The procedure described in Example 1 was repeated, except that 7.5 grams of butyl lithium and 39.3 grams of di[p-(2,4,4-trimethyl-2-pentyl)phenyl]amine was employed. The resulting compound had the following structure:

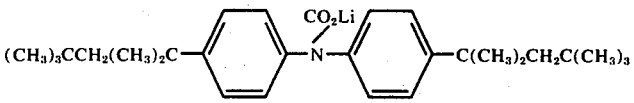

EXAMPLE 6

A solution of 16.9 grams diphenylamine (0.1 mole) in 100 ml tetrahydrofuran was added, dropwise and with stirring, to a suspension of 4.2 grams sodium hydride (57% in mineral oil, washed with pentane) in 400 ml tetrahydrofuran. After the evolution of hydrogen had ceased, dry $CO_2$ was passed through the solution for 30 minutes. Evaporation of the tetrahydrofuran afforded 21.2 grams (90%) of the sodium N, N-diphenylcarbamate, as a greyish solid, m.p. > 250° C. This compound had the following structure:

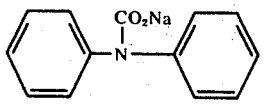

EXAMPLE 7

The procedure described in Example 6 was repeated, employing the same quantity of sodium hydride and 39.3 grams of di[p-(2,4,4-trimethyl-2-pentyl)phenyl]amine. The resulting compound had the following structure:

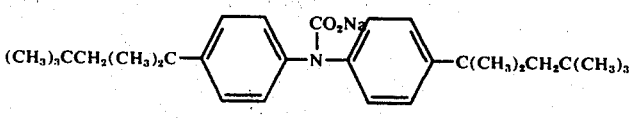

EXAMPLE 8

The procedure described in Example 1 was repeated, except that 6.8 grams of butyl lithium and 26.1 grams of dodecylaniline was employed. The resulting compound had the following structure:

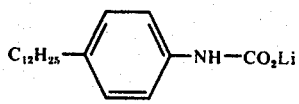

EXAMPLE 9

The procedure described in Example 1 was repeated, except that 17.3 grams of 2,4,4-trimethyldihydroquinoline and 7.5 grams of butyl lithium was employed. The resulting compound had the following structure:

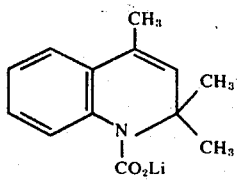

EXAMPLE 10

A solution of di[p-(2,4,4-trimethyl-2-pentyl)-phenyl]amine (19.65g., 0.05 mol) and potassium-tert-butoxide (5.61g., 0.05 mol) in 100 ml tetrahydrofuran was refluxed under on argon atmosphere for 22 hours. The resulting potassium salt precipitated from tetrahydrofuran. The tetrahydrofuran was replaced by adding 1,4-dioxane (200 ml) as the tetrahydrofuran was removed by distillation. A vigorous stream of carbon dioxide was passed through the solution for 1 hour. Upon evaporation of the solvent a yield of 26.9g. of product was obtained. The resulting product had the following structure:

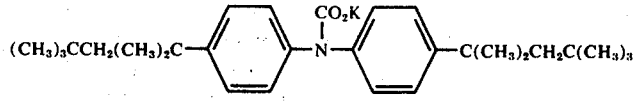

EXAMPLE 11

To a solution of 4g. of the potassium carbamate of Example 10 in 75 ml acetonitrile was added 2.0g. of tetraethylammonium tetrafluoroborate. The solution was stirred 0.5 hours and filtered. To the filtrate was added 35 ml diethyl ether and the solution was filtered again. Evaporation of the solvent yielded 3.15g. of product. The resulting product had the following structure:

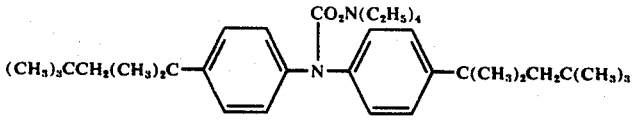

Individual blends of the carbamates of Examples 1 through 11 were prepared in Kuwait oil. This oil was prepared from a Kuwait distillate by furfural refining and methylethyl ketone dewaxing. It had a viscosity at 100° F. of 107 S.U.S. and at 210° F. of 40.1 S.U.S. Oxygen was circulated through each test sample at 175° C. at the rate of 5 liters per hour. The size of each sample was 30 grams. In the following table are summarized the results as the time ($t_{1.0}$) required for 1 kg of oil to absorb 1 mole of oxygen. In this table, the longer the duration of oxygen uptake, the more desirable the antioxidant carbamate additive. Where the carbamate additive was incorporated in the oil, it was present in an amount of 1%, by weight.

TABLE

| CARBAMATE ADDITIVE | | $t_{1.0}$ hours |
|---|---|---|
| Untreated oil | | 20 ± 2 |
| Oil + carbamate of | Ex. 1 | 83.1 |
| & " | Ex. 2 | 62.8 |
| " | Ex. 3 | 80.7 |
| " | Ex. 4 | 87.0 |
| " | Ex. 5 | 65.4 |
| " | Ex. 6 | 119.2 |
| " | Ex. 7 | 55.1 |
| " | Ex. 8 | 28.5 |
| " | Ex. 9 | 56.2 |
| " | Ex. 10 | 62.8 |
| " | Ex. 11 | 73.3 |

From the above examples and comparative data, it will be apparent that the alkali metal arylcarbamates of the present invention are outstandingly effective as antioxidants in organic media such as lubricating oils, and greases in which these lubricating oils are employed as vehicles. It will also be noted that other additives may also be included in the above-described organic compositions which can provide a variety of additional desirable characteristics such as extreme pressure agents, detergents, pour point depressants, stability improvers and viscosity control agents.

While preferred embodiments of the novel process of the present invention have been described for the purposes of illustration, it will be understood that various modifications and adaptations thereof, which will be obvious to those skilled in the art, may be made without departing from the spirit of the invention.

We claim:

1. Aryl carbamates having the structure:

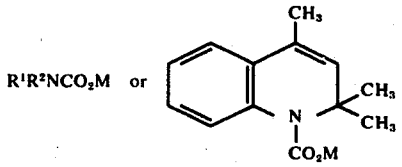

in which $R^1$ and $R^2$ are phenyl, naphthyl, p-(2,4,4-trimethyl-2-pentyl)phenyl or p-dodecyl phenyl; and M is selected from the group consisting of Li, Na, K, Rb, Cs, or tetraalkylammonium.

2. A carbamate as defined in claim 1 wherein $R^1$ and $R^2$ are phenyl or naphthyl.

3. A carbamate as defined in claim 1 having the structure:

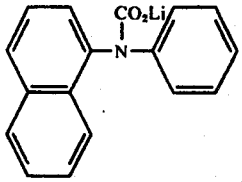

4. A carbamate as defined in claim 1 having the structure:

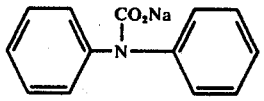

5. A carbamate as defined in claim 1 having the structure:

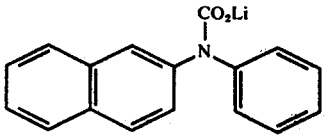

6. A carbamate as defined in claim 1 having the structure:

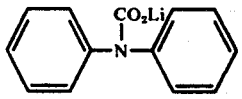

* * * * *

UNITED STATES PATENT AND TRADEMARK OFFICE

CERTIFICATE OF CORRECTION

PATENT NO. : 3,997,597
DATED : December 14, 1976
INVENTOR(S) : Robert F. Bridger, ElAhmadi I. Heiba, Stamoulis Stournas It is certified that error appears in the above-identified patent and that said Letters Patent are hereby corrected as shown below:

Column 5, line 66 "2,4,4" should be --2,2,4--.

Signed and Sealed this

*sixteenth* Day of *August 1977*

[SEAL]

*Attest:*

RUTH C. MASON
*Attesting Officer*

C. MARSHALL DANN
*Commissioner of Patents and Trademarks*